US005785364A

United States Patent [19]

Kleefeldt et al.

[11] Patent Number: 5,785,364

[45] Date of Patent: Jul. 28, 1998

[54] SERVO-TIGHTENING MOTOR-VEHICLE DOOR LATCH

[75] Inventors: Frank Kleefeldt, Heiligenhaus; Damien Labonde, Essen; Johannes-Theodor Menke, Velbert; Stefan Armbruster, Heiligenhaus; Thomas Schönenberg, Leverkusen, all of Germany

[73] Assignee: Kiekert AG, Heiligenhaus, Germany

[21] Appl. No.: 831,979

[22] Filed: Apr. 2, 1997

[30] Foreign Application Priority Data

Apr. 2, 1996 [DE] Germany ..... 196 13 114.6
Jun. 1, 1996 [DE] Germany ..... 296 09 770 U

[51] Int. Cl.[6] ..... E05C 3/06

[52] U.S. Cl. ..... 292/201; 292/341.16

[58] Field of Search ..... 292/201, 341.16, 292/DIG. 23, DIG. 43, DIG. 62

[56] References Cited

U.S. PATENT DOCUMENTS

| | | | |
|---|---|---|---|
| 4,906,035 | 3/1990 | Nagai et al. | 292/341.16 |
| 4,968,074 | 11/1990 | Yamagishi et al. | 292/201 |
| 5,222,775 | 6/1993 | Kato | 292/201 |
| 5,232,253 | 8/1993 | Tamiya | 292/201 |
| 5,273,325 | 12/1993 | Zimmerman | 292/341.16 |
| 5,423,582 | 6/1995 | Kleefeldt | 292/201 |
| 5,564,761 | 10/1996 | Mizuki et al. | 292/201 |
| 5,613,716 | 3/1997 | Cafferty | 292/201 |

FOREIGN PATENT DOCUMENTS 40 22 811 1/1992 Germany .

*Primary Examiner*—Steven N. Meyers
*Assistant Examiner*—Tuyet-Phuong Pham
*Attorney, Agent, or Firm*—Herbert Dubno; Andrew Wilford

[57] ABSTRACT

A motor-vehicle door latch has a door-mounted fork displaceable between an open and a fully latched position and through an intermediate semilatched position and a body-mounted door bolt engageable with the fork and retainable thereby only in the semilatched and fully latched positions. A door-mounted pawl can pivot about a pawl axis between a holding position engaging and retaining the fork in the fully latched and semilatched positions and a freeing position permitting the fork to move freely between its positions. A controller is connected to a servomotor in turn coupled to the door bolt for displacing same between an outer and an inner position so that, when the bolt is engaged with the fork in the fully latched position, movement of the bolt into the inner position pulls a door carrying the latch tightly closed. A switch lever can pivot about the pawl axis. Interengaging formations on the switch lever, on the pawl, and on the fork displace the switch lever into a first position with the fork in the semilatched and open positions and with the pawl in the open position and displace the switch into a second position with the fork in the fully latched position. A switch between the control means and the switch lever prevents operation of the servomotor except in the second position of the switch lever.

3 Claims, 2 Drawing Sheets

SERVO-TIGHTENING MOTOR-VEHICLE DOOR LATCH

FIELD OF THE INVENTION

The present invention relates to a motor-vehicle door latch. More particularly this invention concerns such a latch which, once latched, is pulled by a servomotor into a fully closed position.

BACKGROUND OF THE INVENTION

A standard motor-vehicle door latch has a housing normally mounted on a door latch and holding a latch fork displaceable from an open position through a semilatched position to a fully latched position. A pawl in the housing is displaceable between a freeing position in which it allows the fork to pivot freely between its position and a holding position in which it engages the fork in the semilatched and fully latched positions. A door bolt normally mounted on the motor-vehicle door post is engageable with the fork and retainable thereby in the semilatched and fully latched positions. Thus as the door is closed the bolt first moves the fork into the semilatched position, in which it is retained by the pawl and in which the door is loosely closed, and on further closing of the door the bolt pushes the fork into the fully latched position, in which it is also retained by the pawl and in which the door is fully closed. In either the semilatched or fully latched position, shifting of the pawl into the freeing position allows the fork to pivot back out, normally biased by a spring, into the open position in which the bolt is wholly released by the fork.

In order to hold the door very tightly closed without requiring that it be slammed shut, it is known to provide the latch with a servomechanism of the type described in U.S. Pat. No. 5,217,266. In this arrangement the bolt is mounted on a high-torque crank mechanism powered by an electric motor in the door post. When the fork is in the fully closed position, a controller operates the motor to pull the bolt in a further increment that brings the door completely flush with the car and closes it very tightly. Thus the user need merely swing the door to, enough to shift the fork into the fully latched position, whereupon the servomechanism takes over to move the door further into the fully closed position.

Normally the servomechanism is tripped by a switch operated by the latch pawl. Thus when the latch pawl is in the engaged position the servomechanism takes over to shift the door into the fully closed position. This problem can also come up when the door is released but does not open fully. When the servo is actuated without the fork in the fully latched position, the result is that the door controllers will report that the door is fully closed when it is not, creating a potentially dangerous situation.

OBJECTS OF THE INVENTION

It is therefore an object of the present invention to provide an improved motor-vehicle door latch.

Another object is the provision of such an improved motor-vehicle door latch which has a servo-tightening feature and overcomes the above-given disadvantages, that is which will attempt to shift the door into the fully closed position except when it is fully latched.

SUMMARY OF THE INVENTION

A motor-vehicle door latch has according to the invention a door-mounted fork displaceable between an open and a fully latched position and through an intermediate semilatched position and a body-mounted door bolt engageable with the fork and retainable thereby only in the semilatched and fully latched positions. A door-mounted pawl can pivot about a pawl axis between a holding position engaging and retaining the fork in the fully latched and semilatched positions and a freeing position permitting the fork to move freely between its positions. A controller is connected to a servomotor in turn coupled to the door bolt for displacing same between an outer and an inner position so that, when the bolt is engaged with the fork in the fully latched position, movement of the bolt into the inner position pulls a door carrying the latch tightly closed. A switch lever can pivot about the pawl axis. Interengaging formations on the switch lever, on the pawl, and on the fork displace the switch lever into a first position with the fork in the semilatched and open positions and with the pawl in the open position and displace the switch into a second position with the fork in the fully latched position. A switch between the control means and the switch lever prevents operation of the servomotor except in the second position of the switch lever.

Thus with this system the controller-operated motor will only be able to move the bolt into the inner position when the latch is fully latched. If the pawl is pivoted to open the door this action alone will operated the switch to signal to the controller to back off the bolt, and when the fork itself moves into the semilatched or open position this will also act on the switch lever to prevent the controller from moving back the bolt. Only in the fully latched position of the bolt and the holding position of the pawl can the switch signal to the controller that the bolt can be shifted for the supertight closing of the door. Even if the door is held shut, as for instance by ice, if the pawl is pulled clear of the fork it will operate the motor to push out the door. Similarly if the door is held closed but the latch is not in engagement with the fork, the motor will not be able to operate to pull in the door.

According to the invention the fork has respective steps engageable radially of the pawl axis with the pawl in the semilatched and fully latched positions of the fork. In addition the formations include an arm on the switch lever and an edge surface on the fork. The arm is engageable with the edge surface in the semilatched and open positions of the fork.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
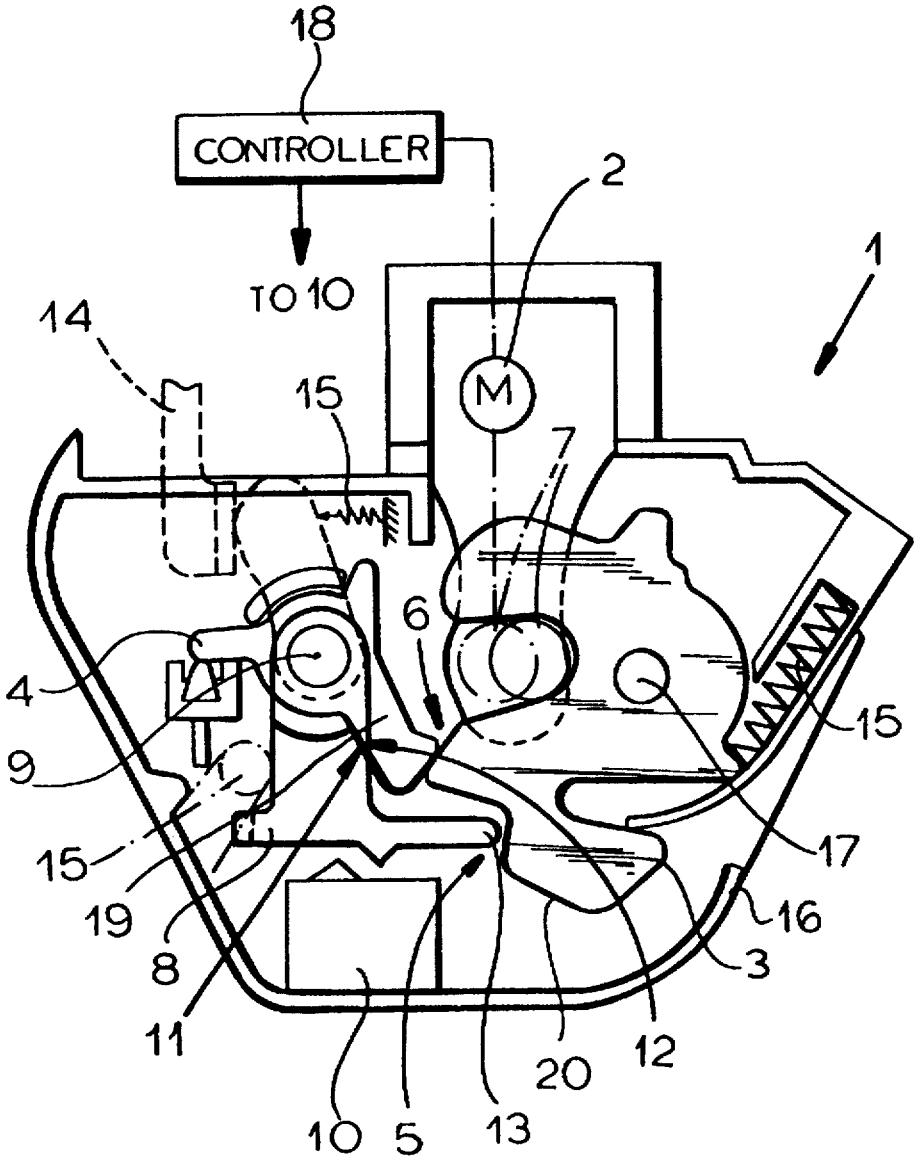
FIG. 1 is a partially diagrammatic sectional view through a latch according to the invention in the fully latched position.

As seen in FIG. 1 a motor-vehicle door latch 1 comprises a housing 16 normally mounted on the edge of a door and a bolt 7 normally mounted on a door post or the body of the vehicle. The bolt 7 is movable in the direction D into and out of the housing 16 and a motor illustrated schematically at 2 can also displace it limitedly in the direction D as shown by the solid and dot-dash positions of FIG. 1.

As is standard, the latch has a fork 3 pivotal about a fork axis 17 and formed with a cutout that can engage around the bolt 7. As the bolt 7 moves into the latch the fork 3 is pivoted from an unillustrated open position to a semilatched position shown in FIG. 2 and into an end fully latched position shown in FIG. 1. When in the fully latched position a controller 18 operates the motor 2 to advance the bolt 7 inward from the solid-line to the dot-dash position to pull the door carrying the housing 16 very tightly closed.

A latch pawl 4 has an arm 19 engageable with either of two steps 5 or 6 of the fork in the semilatched and fully latched positions, respectively. When thus engaged the fork 3 is retained in the respective position. This pawl 4 is pivoted about its axis 9 by an operating lever 14 operated by the door-latching mechanism, for instance the inside and/or outside door handles or a key cylinder or solenoid.

A switch lever 8 has an arm 13 engageable with an edge 20 of the fork 3 in the semilatched and open positions of the fork 3 and an edge 12 engageable with an edge 11 of the pawl 4. This lever 8 is engageable with a switch 10 connected to the controller 18. Springs 15 urge the fork 3 into the open position, the pawl 4 into the illustrated holding position, and the lever 15 into the FIG. 1 second position.

This system works as follows:

When the door is open and the fork 3 is in the unillustrated open position, its edge 20 pushes the lever 8 down and actuates the switch 10 into a first position so that the controller 18 cannot operate the motor 2 and the bolt 7 is in its outer position.

Figure 2:
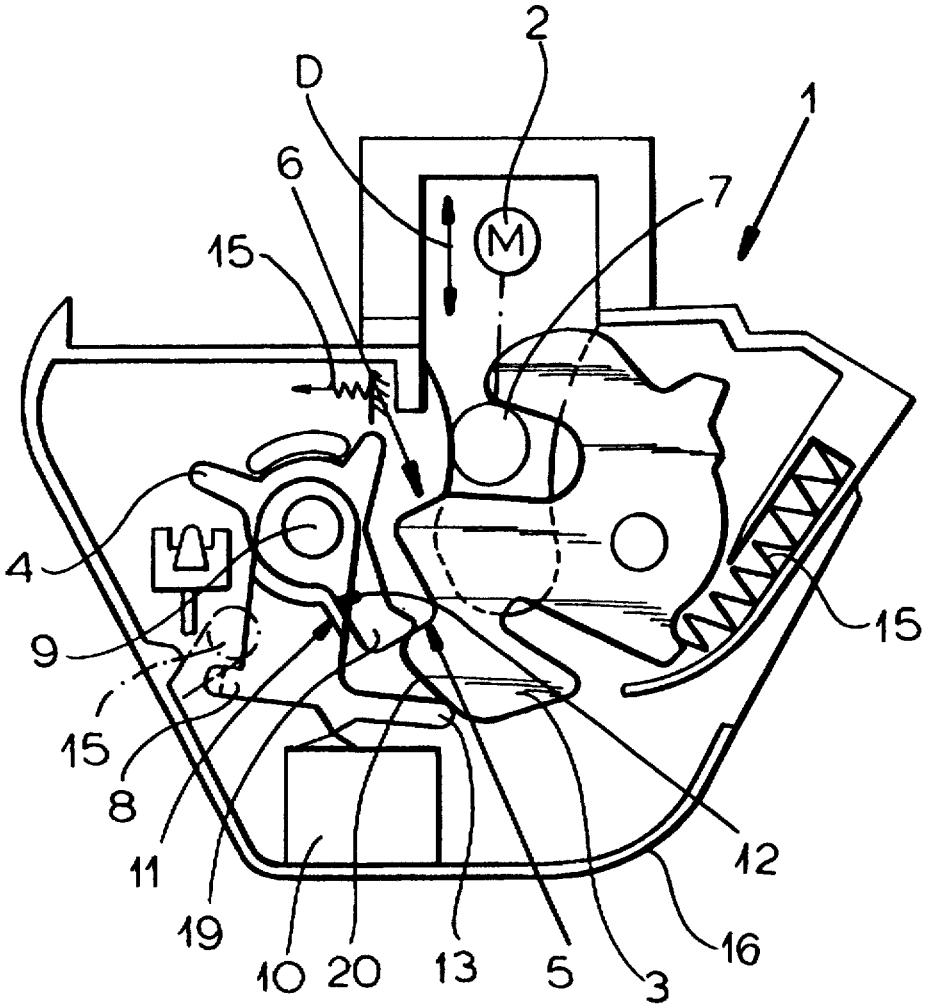
FIG. 2 is a view like FIG. 1 but with the latch in the semilatched position.

As the door is closed the fork 3 is pivoted by the bolt 7 counter clockwise first into the semilatched position of FIG. 2. In this position the edge 20 continues to push down the arm 13 and push the lever 8 against the switch 10, preventing operation of the motor 2 by the controller 18 by retaining the switch 10 in the first position. In this position there is still a slight spacing between the surfaces 11 and 12 so that the pawl 4 is not acting on the switch lever 8.

With further closing of the door the fork 3 is pivoted into the fully latched position of FIG. 1 and the arm 13 loses contact with the surface 20, so the spring 15 can pivot the lever 8 back up until the surfaces 11 and 12 abut and the lever 8 loses contact with the switch 10. This signals to the controller 18 that the motor 2 can be operated to shift the bolt 7 in the direction of arrow D and thereby pull the door very tightly closed.

When the door is to be opened by pushing of the lever 14 against the pawl 4, the surface 11 pushes down against the surface 12 and moves the lever 8 down to operate the switch 10. This signals to the controller 18 to reverse the motor 2 and back off the bolt 7, while at the same time the pawl 4 releases the fork 3 so the bolt 7 can move out of the latch and the fork 3 can assume the open position.

We claim:

1. A motor-vehicle door latch comprising:

a fork displaceable between an open and a fully latched position and through an intermediate semilatched position;

a bolt engageable with the fork and retainable thereby only in the semilatched and fully latched positions;

a pawl pivotal about a pawl axis between a holding position engaging and retaining the fork in the fully latched and semilatched positions and a freeing position permitting the fork to move freely between its positions;

control means including a servomotor coupled to the bolt for displacing same between an outer and an inner position, whereby, when the bolt is engaged with the fork in the fully latched position, and whereby, when the latch is mounted on a door, movement of the bolt into the inner position pulls the door tightly closed;

a switch lever pivotal about the pawl axis;

means including interengaging formations on the switch lever, on the pawl, and on the fork for displacing the switch lever into a first position with the fork in the semilatched and open positions and with the pawl in the open position and for displacing the switch into a second position with the fork in the fully latched position; and switch means between the control means and the switch lever for preventing operation of the servomotor except in the second position of the switch lever.

2. The motor-vehicle door latch defined in claim 1 wherein the fork has respective steps engageable radially of the pawl axis with the pawl in the semilatched and fully latched positions of the fork.

3. The motor-vehicle door latch defined in claim 1 wherein the formations include an arm on the switch lever and an edge surface on the fork, the arm being engageable with the edge surface in the semilatched and open positions of the fork.

* * * * *